US008393127B1

(12) United States Patent
Jensen

(10) Patent No.: US 8,393,127 B1
(45) Date of Patent: Mar. 12, 2013

(54) RELOCATABLE RESTAURANT AND ASSOCIATED METHODS

(76) Inventor: Kyle R. Jensen, Apopka, FL (US)

( * ) Notice: Subject to any disclaimer, the term of this patent is extended or adjusted under 35 U.S.C. 154(b) by 0 days.

(21) Appl. No.: 12/758,168

(22) Filed: Apr. 12, 2010

Related U.S. Application Data

(60) Provisional application No. 61/169,059, filed on Apr. 14, 2009.

(51) Int. Cl.
*E04B 1/00* (2006.01)

(52) U.S. Cl. ..... 52/745.01; 52/64; 52/79.5; 52/79.7; 52/79.9; 52/645; 52/127.1

(58) Field of Classification Search ..... 52/79.4, 52/79.5, 79.7, 79.9, 2.11, 2.13, 2.14, 2.19, 52/2.22, 126.7, 127.1, 641, 645, 646, 745.01
See application file for complete search history.

(56) References Cited

U.S. PATENT DOCUMENTS

| | | | | |
|---|---|---|---|---|
| 3,222,030 | A * | 12/1965 | Thorpe | 254/100 |
| 4,325,205 | A * | 4/1982 | Salim et al. | 52/79.1 |
| 5,088,245 | A * | 2/1992 | Anderson | 52/82 |
| 5,168,681 | A * | 12/1992 | Ayrapetyan | 52/223.7 |
| 5,570,549 | A * | 11/1996 | Lung et al. | 52/295 |
| 5,819,482 | A * | 10/1998 | Belke et al. | 52/126.6 |
| 6,282,842 | B1 * | 9/2001 | Simens | 52/2.11 |
| 6,484,454 | B1 * | 11/2002 | Everhart | 52/79.4 |
| 7,793,466 | B2 * | 9/2010 | de Cherance | 52/64 |
| 7,941,975 | B2 * | 5/2011 | Ingjaldsdottir et al. | 52/79.12 |
| 2004/0163334 | A1 * | 8/2004 | Carlson | 52/126.6 |

OTHER PUBLICATIONS

Designboom, Container Buildings (12 articles), Designboom, [retrieved on Jul. 15, 2010]. Retrieved from the Internet: <URL:http://www.designboom.com/weblog/keyword.php?keyword=container-buildings&start=10&num_record_tot=12>.

Projects for shipping container houses and community buildings, Shipping Container Housing Guide, [retrieved on Jul. 15, 2010]. Retrieved from the Internet: <http://www.shipping-container-housing.com/shipping-container-houses. html>.

Shipping Container Building Construction Basics, Runkle Consulting Inc., [retrieved on Jul. 15, 2010]. Retrieved from the Internet: <http://www.runkleconsulting.com/Shipping%20Container%20Houses/shipping_container_building_design_and_construction.html>.

Shipping Container Buildings, Runkle Consulting Inc., [retrieved on Jul. 15, 2010]. Retrieved from the Internet: <http://www.runkleconsulting.com/ShippingContainerHouses/shippingcontainerhouses.htm>.

Shipping Container Houses, Runkle Consulting Inc., [retrieved on Jul. 15, 2010]. Retrieved from the Internet: <http://www.runkleconsulting.com/Shipping%20Container%20Houses/shiping%20container%20houses.htm>.

Bouldercrest Shell, Runkle Consulting Inc., [retrieved on Jul. 15, 2010]. Retrieved from the Internet: <http://www.runkleconsulting.com/projects/bouldercrest_shell.htm>.

(Continued)

*Primary Examiner* — William Gilbert
*Assistant Examiner* — Gisele Ford
(74) *Attorney, Agent, or Firm* — Carl M. Napolitano; GrayRobinson, P.A.

(57) ABSTRACT

A relocatable restaurant, method of assembly, and method of use are provided herein. The relocatable restaurant includes a slab positioned at a desired site, a plurality of modules, including in an exemplary embodiment one module for each of a kitchen, a dishwashing and bar, and bathroom facilities. The modules are positionable atop the slab adjacent exterior edges thereof. In an embodiment, a slab can be provided by an existing structure, such as a parking lot. The relocatable restaurant further includes a plurality of partitions sufficient for bridging the modules, at least one partition having a door structure, to create a substantially continuous exterior wall therearound. A roof is provided for the relocatable restaurant with the use of a substantially planar flexible element affixable about the exterior wall. A blower can be used to retain the roof in an upwardly extended state.

19 Claims, 14 Drawing Sheets

OTHER PUBLICATIONS

Container Creations, [retrieved on Jul. 15, 2010]. Retrieved from the Internet: <http://www.container-creations.com/home_html>.
Portable Buildings, Inc. [retrieved on Jul. 15, 2010]. Retrieved from the Internet: <http://www.portablebuildingsinc.com/index.html>.
Portable Building, Wikipedia, the free encyclopedia, [retrieved on Jul. 15, 2010]. Retrieved from the Internet: <http://en.wikipedia.org/wiki/Portable_building>.
Whitley Manufacturing's Green Modular Buildings, Whitley Manufacturing, [retrieved on Jul. 15, 2010]. Retrieved from the Internet: <http://www.whitleyman.com/green.html>.
Client: Autochair Ltd. Modular Buildng Head Office Accommodation with disabled accessibility; Relocatable Building Systems Ltd., Portable cabins and Modular Buildings—Projects, [retrieved on Jul. 15, 2010]. Retrieved from the Internet: <http://www.relocatablebuildingsystems.co.uk/index.php?page=projects& s ub=project5>.
Client: ISG Jackson, Site Accommodation Complex, Relocatable Building Systems Ltd., Portable cabins and Modular Buildings—Projects, [retrieved on Jul. 15, 2010]. Retrieved from the Internet: <http://www.relocatablebuildingsystems.co.uk/index.php?page=projects&sub=project2>.
Modular Fabric Building Span Configurations—Prefabricated Module Designs, Rubb International A/S, [retrieved on Jul. 15, 2010]. Retrieved from the Internet: <http://www.rubb.com/rubb-building-types.php>.
Relocatable Buildings & Portable Structures, Shelter Structures, Inc., [retrieved on Jul. 15, 2010]. Retrieved from the Internet: <http://shelterstructures.com/relocatable-buildings.html>.
Rite-Away Relocatable Building Systems and Metal Buildings, Roll Up Doors Direct, [retrieved on Jul. 15, 2010]. Retrieved from the Internet: <http://www.rollupdoorsdirect.com/riteaway_relocatable_building.htm>.
Commercial Buildings, Universal Modular Building Solutions, Inc., [retrieved on Jul. 15, 2010]. Retrieved from the Internet: <http://www.umodular.com/markets/commercial/>.
Why Modular Construction? Modular Space Corporation, [retrieved on Jul. 15, 2010]. Retrieved from the Internet: <http://www.modspace.com/resources/why-modular-construction/>.
Nadler Modular Structures: Floor Plans, [retrieved on Jul. 15, 2010]. Retrieved from the Internet: <http://www.nadlermobile.com/floor_plans.shtml>.
Innovative Modular Building Solutions, NRB, Inc., [retrieved on Jul. 15, 2010]. Retrieved from the Internet: <http://www.nrb-inc.com/buildings-modular.php>.
Relocatable Buildings, U.S. Door & Building Components, [retrieved on Jul. 15, 2010]. Retrieved from the Internet: <http://www.usdoor.com/relocatables.html>.
Shipping Container Architecture by Zack Smith, [retrieved on Jul. 15, 2010]. Retrieved from the Internet: <http://home.comcast.net/~plutarch/>.
Global Container Buildings, [retrieved on Jul. 15, 2010]. Retrieved from the Internet: <http://www.globalcontainerbuildings.com/newconstruction.htm>.
Global Container Buildings, [retrieved on Jul. 15, 2010]. Retrieved from the Internet: <http://www.globalcontainerbuildings.com/newjamaica>.

* cited by examiner

RELOCATABLE RESTAURANT AND ASSOCIATED METHODS

CROSS-REFERENCE TO RELATED APPLICATION

This application claims priority to provisional patent application Ser. No. 61/169,059, filed on Apr. 14, 2010.

BACKGROUND

1. Field of the Invention

The present invention relates to constructions and methods for establishing a temporary building structure, and, more particularly, to such structures and methods for establishing a relocatable restaurant.

2. Description of Related Art

The concept of establishing temporary structures such as dwellings by assembling a plurality of modules together is known in the art. It is also known to vend food from movable structures that are typically on wheels and can be self-propelled or pulled with another vehicle.

It is also known to inflate a roof using a blower, such as to create a pseudo-indoor tennis court in inclement weather.

When a more substantial structure is desired, however, materials are used to actually construct a building, complete with a foundation, even if the need for the building is temporary. As soon as the building is no longer needed, the building is deconstructed, and the materials often disposed of and not re-used, which is contrary to current trends towards environmentally friendly building.

Buildings in which food preparation is desired to be performed can be particularly difficult to construct, owing to stringent building codes, and therefore temporary restaurant structures have not been able to be economically and effectively designed and built.

Therefore, it would be beneficial to provide a construction, method of assembly, and method of use for an environmentally friendly, modular, and easily assembled and relocatable restaurant building.

SUMMARY

A relocatable restaurant, method of assembly, and method of use are provided herein. In an embodiment, the relocatable restaurant comprises a base comprising a slab positioned at a desired site for the relocatable restaurant. In another embodiment, the base comprises a floatable platform, such as a barge. In a further embodiment, the base can comprise support members positioned atop a site surface.

The relocatable restaurants further comprise a plurality of modules, including in an exemplary embodiment one module for each of a kitchen, a dishwashing and bar, and bathroom facilities. In another embodiment, two modules are included, one module for bathroom facilities and another for kitchen/dishwashing equipment. In yet a further embodiment, the modules can comprise a first module containing a kitchen and mechanical apparatus, a second module containing dishwashing facilities, a bar, and an office, and a third module containing bathroom facilities, mechanical apparatus, and storage. The modules are positionable atop the base adjacent exterior edges thereof. In an embodiment for use, for example, in emergency scenarios, a slab can be provided by an existing structure, such as a parking lot.

The relocatable restaurant further comprises a plurality of partitions sufficient for bridging the modules, at least one partition having a door structure, to create a substantially continuous exterior wall therearound.

A roof is provided for the relocatable restaurant with the use of a substantially planar flexible element affixable about the exterior wall. A blower can be used to retain the roof in an upwardly extended state.

The relocatable restaurant construction has a multiplicity of advantages, some of which include that it is substantially completely retrievable and relocatable (except for the slab and tie-ins, if used), all known building codes and standards are met, and it is environmentally friendly in "recycling" virtually all elements for re-use at another site. The U.S. Green Building Council has established 69 criteria in six categories that applied to almost all aspects of green building. Credits are given for a "material reuse" category for that portion of a building that can be reused. The present invention diverts construction materials from landfills, reuses materials, uses recycled content in the construction materials, and incorporates regional materials therein.

In the building and methods of the present invention, water and an airtight envelope is assembled, used, and disassembled without destructive means such as cutting calk joints. A container-based first floor is supported with leveling jacks, secured at hard points, and bound together by a perimeter fascia beam from which the roof is secured. Although not intended as limiting, an air-supported roof is believed to be preferred at the time of filing to enable rapid relocation time. The building also comprises a raised floor using honeycomb panels supported at the perimeter by containers.

The relocatable restaurant utilizes sub-spaces within the structural walls as opposed to inside the perimeter of the walls. The structure does not use the walls for tensile connection to the ground; rather, only compression is used, as tie downs are attached to a perimeter beam.

The first floor is container-based and supported with leveling jacks. The floor is secured at hard points, and bound together by a perimeter fascia beam from which the roof is secured.

The restaurant is designed to function not only in its operable configuration, but also in its non-operable configuration during travel as a shipping container. Thus the relocatable restaurant building is shipped to a target site with its food, refer, water, and fuel already aboard, as opposed to needing to be stocked with food after completion.

The building's subunits can be manufactured inexpensively, for example, overseas at discount and then shipped to a region of use.

The building in a particular embodiment can use ceramic micro-sphere paint systems for exterior insulation. The building has a cooking grease duct system, which is fabricated into a unit and removed from the hood and kitchen container for cleaning and relocation. Power and water systems are portable and use in situ service, fuel, water, and sewage services. Containment can be provided by bladder-type systems filled and serviced at the site.

In the structure of the present invention, an airtight envelope is assembled, used, and disassembled without destructive means like cutting calk joints, etc. A container is supported with elements such as leveling jacks, secured at hard points, bound together by a perimeter fascia beam from which the roof is secured. An air-supported roof is believed preferable for fast relocation time.

The relocatable restaurant structure utilizes sub-spaces within the structural walls, as opposed to inside the perimeter of the walls. The walls are not used for tensile connection to the ground, only compression, as tie downs are attached to perimeter beam.

The structure is designed to function not only in its operable configuration, but also in its non-operable configuration during travel as a transport device. The relocatable restaurant structure can be shipped to the site with its food, water, and fuel if desired, as opposed to being stocked with food after completion.

Power and water systems can be portable and be serviced in situ. Containment can be provided by bladder-type systems filled and serviced at the site.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

A description of the preferred embodiments of the present invention will now be presented with reference to FIGS. 1A-20.

Figure 1B:
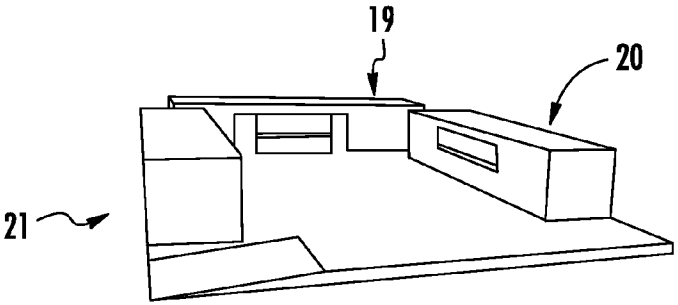
FIGS. 1A-1D illustrate a method of assembling an exemplary relocatable restaurant.
Figure 1D:
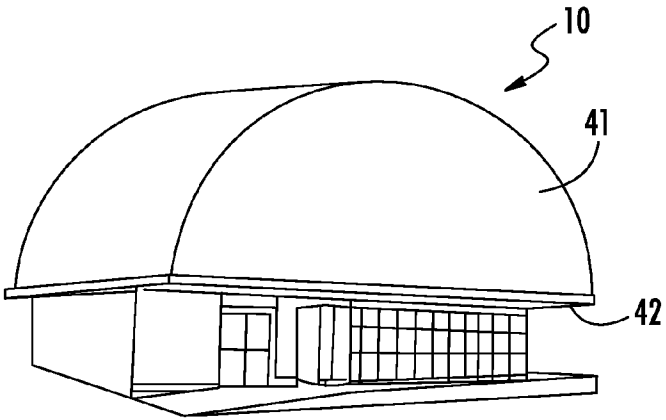
Figure 1A:
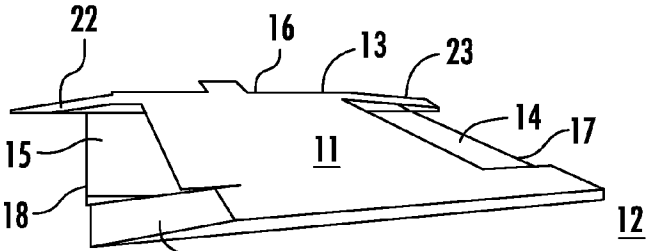
Figure 1C:
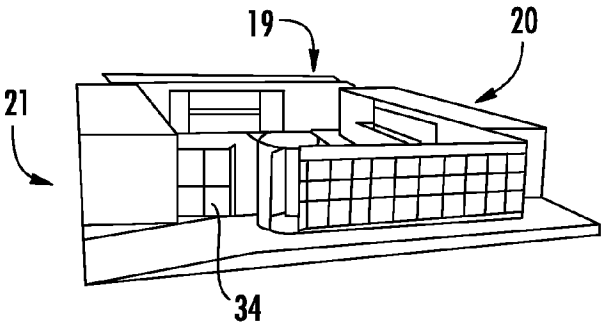

The present invention is directed to a relocatable restaurant, method of assembly, and method of use. In one embodiment (FIGS. 1A-6), the relocatable restaurant 10 can be constructed by positioning or using an already-positioned slab 11 at a desired site 12 (FIG. 1A) for the relocatable restaurant 10. In a particular embodiment, the slab 11 is substantially rectangular and substantially planar, having three substantially rectangular recesses 13-15 along three edges 16-18 thereof. Preferably the slab 11 will have incorporated therein utility tie-ins. The recesses 13-15 are dimensioned for positioning a plurality of modules, here, three containers 19-21, thereon (FIG. 1B). The slab 11 can further include one or more ramps, here three ramps 22-24, for patron access and for bringing in supplies. Here two of the ramps 22,23 extend beyond the slab edges 17,18, and one ramp 24 terminates at the slab edge 18.

In an exemplary embodiment the containers 19-21 comprise a kitchen module 19, a dishwashing and bar module 20, and a module 21 housing bathroom facilities. An exemplary construction and layout for the modules 19-21 will be discussed in the following.

In an embodiment for use, for example, in emergency scenarios, a slab can be provided by an existing structure, such as a parking lot, into which screw-in anchors can be placed, and utilities can be provided in portable containers and generators used. The modules 19-20 can comprise, for example, ISO shipping containers, which can be easily transported.

In another embodiment, pre-manufactured floor modules could be provided for positioning on a scaffolding system with adjustable legs, and then covered with a flooring material, such as carpet. Here the screw-in anchors can support the containers above grade, at the level of the raised floor, to accommodate sites having contour and/or grade.

In an exemplary embodiment (FIG. 10), a wall panel 120 can be provided having a door 121 contained therein. The wall panel 120 can be secured on opposed sides 122,123 with sliding bolts 124, for example, that engage corresponding holes 125 in the containers 126. Such a construction has structural integrity, as all parts are pinned together.

The next step of erecting the relocatable restaurant 10 comprises positioning a plurality of partitions sufficient for bridging the modules 19-21 (FIGS. 1C and 6) to create a substantially continuous exterior wall therearound. Two partitions 25,26 bridge between the kitchen module 19 and the other modules 20,21, and can contain exits 27,28. Along a fourth edge 29 of the slab 11 extends a front wall 30, which can include an entry door 31 adjacent the ramp 24. This front wall 30 can comprise two parallel, staggered sectors 32,33 bridged by the entry door 31, and at least one window 34, although this is not intended as a limitation.

The relocatable restaurant is then outfitted with furniture and other accoutrements (FIG. 6), such as indoor tables 35, outdoor tables, a food preparation table 37 and sink 38, and barstools 39 positioned against a bar 40 in the dishwashing and bar module 20. In an embodiment, the table and bar tops could be provided by panels that are used to close up the modules 19-21 during shipment.

Figure 3:
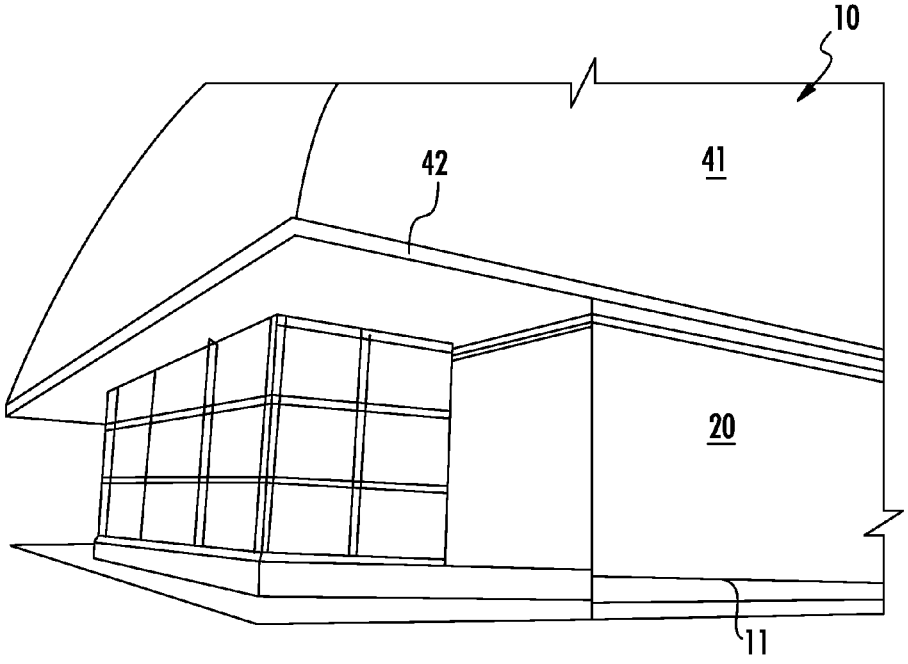
FIG. 3 is an exterior perspective view of the relocatable restaurant from a front right corner thereof.

A roof 41 is provided for the relocatable restaurant 10 with the use of a substantially planar flexible element affixable about the exterior wall via a perimeter soffit beam 42 that is structurally affixed to the modules 19-21 (FIG. 3). A fractional-horsepower blower can be used to retain the roof 41 in a dome-like, upwardly extended state (FIG. 1E). In locations where an air-supported system is not desired, a sectional box beam steel roof can be used.

Figure 12:
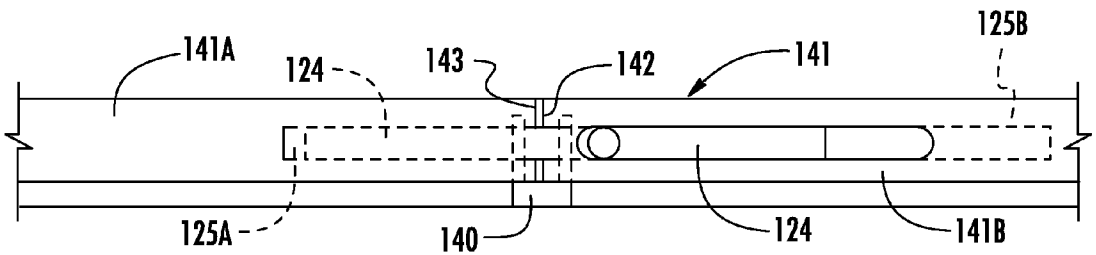
FIG. 12 is an enlarged cross-sectional view of a soffit beam mid-span connector of FIG. 13.
Figure 13:
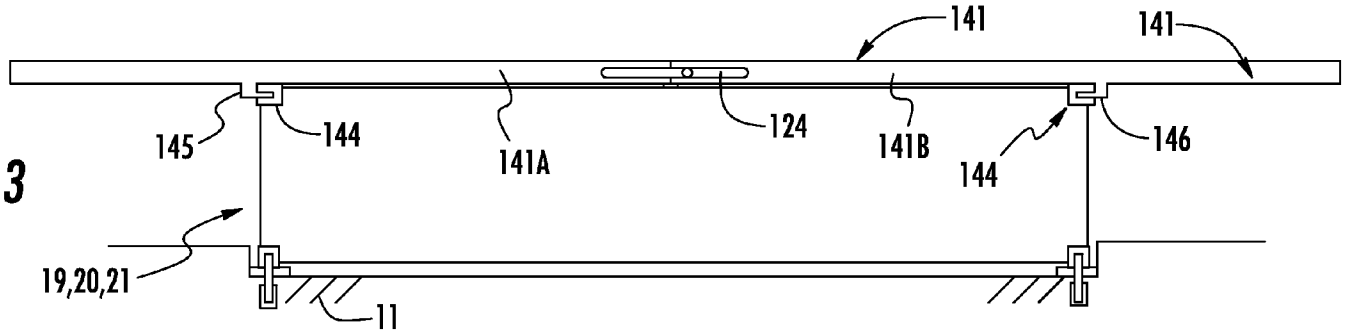
FIG. 13 is an elevation of a container, illustrating U-pin anchors, a soffit beam attachment, and U-pin mid-span anchor assembly.

In one embodiment illustrated with reference to FIG. 12, a sliding pin 124 extends into holes 125A and 125B and is used to connect ends 142,143 of first and second soffit beam sections 141A 141B forming a soffit beam 141. With continued reference to FIG. 12 and now to FIG. 13, tabs 145, 146 located at end opposing end portions of the soffit beam 141 are dimensioned to be attached to hard corners 144 of the containers 19-21, earlier described with reference to FIG. 1B as the soffit beam sections are slid into abutting arrangement. A U-shaped pin 140 is secured between the ends 142, 143. This thereby locks the beams 141 into hard corners 144 of the containers 19-21. The multiple soffit beams 141, through their mating beam sections 141A, 141B, are designed to slide horizontally into the container hard corners 144, and thus form a perimeter attachment, the perimeter soffit beam 42 above described with reference to FIG. 3, for the roof 41, and thus locking components into a rigid, unitary structure. The containers 19-21 connect the roof 41 to the foundation 11 and thereby support gravity load and uplift.

Figure 2:
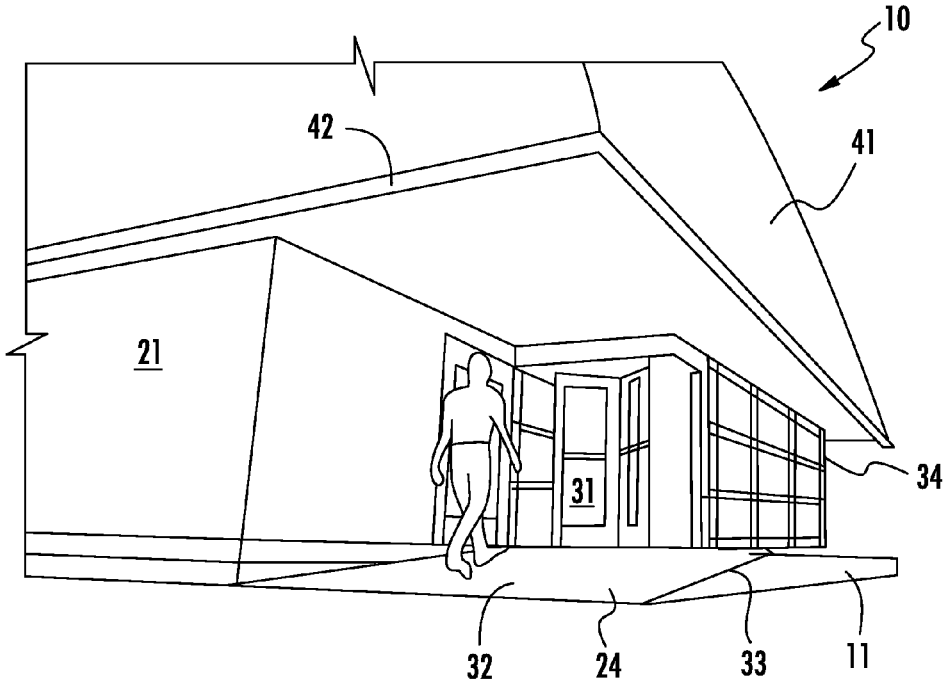
FIG. 2 is an exterior perspective new of an exemplary relocatable restaurant from an entrance thereinto.
Figure 4:
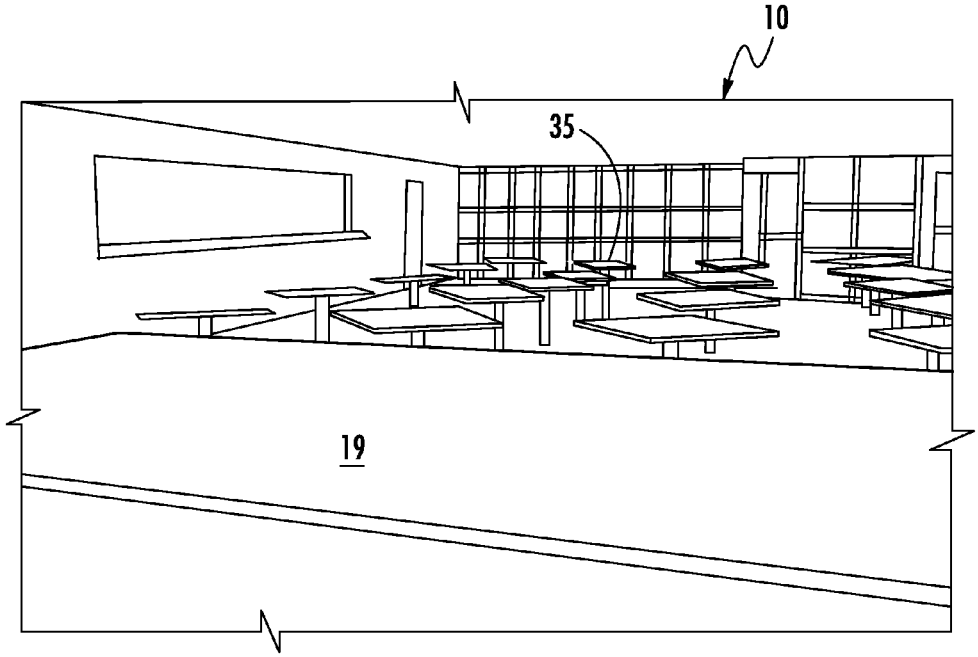
FIG. 4 is an interior perspective view of the relocatable restaurant from a kitchen thereof.
Figure 5:
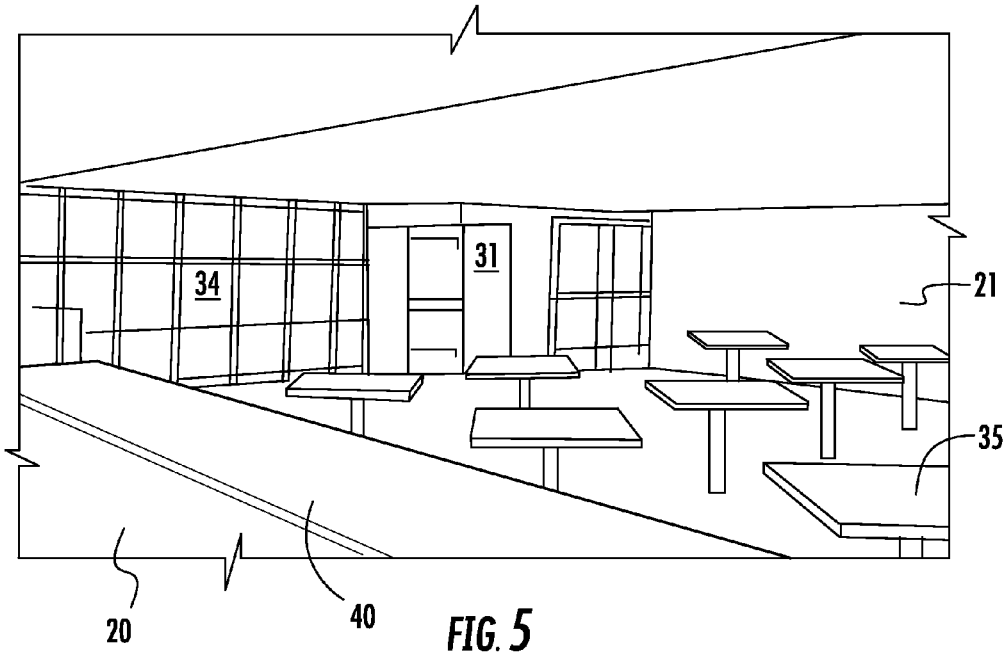
FIG. 5 is an interior perspective view of the relocatable restaurant from a bar thereof.

Exemplary perspective views of parts of the relocatable restaurant 10 are provided in FIGS. 2-5. FIG. 2 illustrates an exemplary entryway; FIG. 3, an exemplary corner area, wherein a bench and railing could be positioned. FIG. 4 illustrates an exemplary interior perspective from the kitchen module 19; FIG. 5, an exemplary interior perspective from the bar 40.

Figure 6:
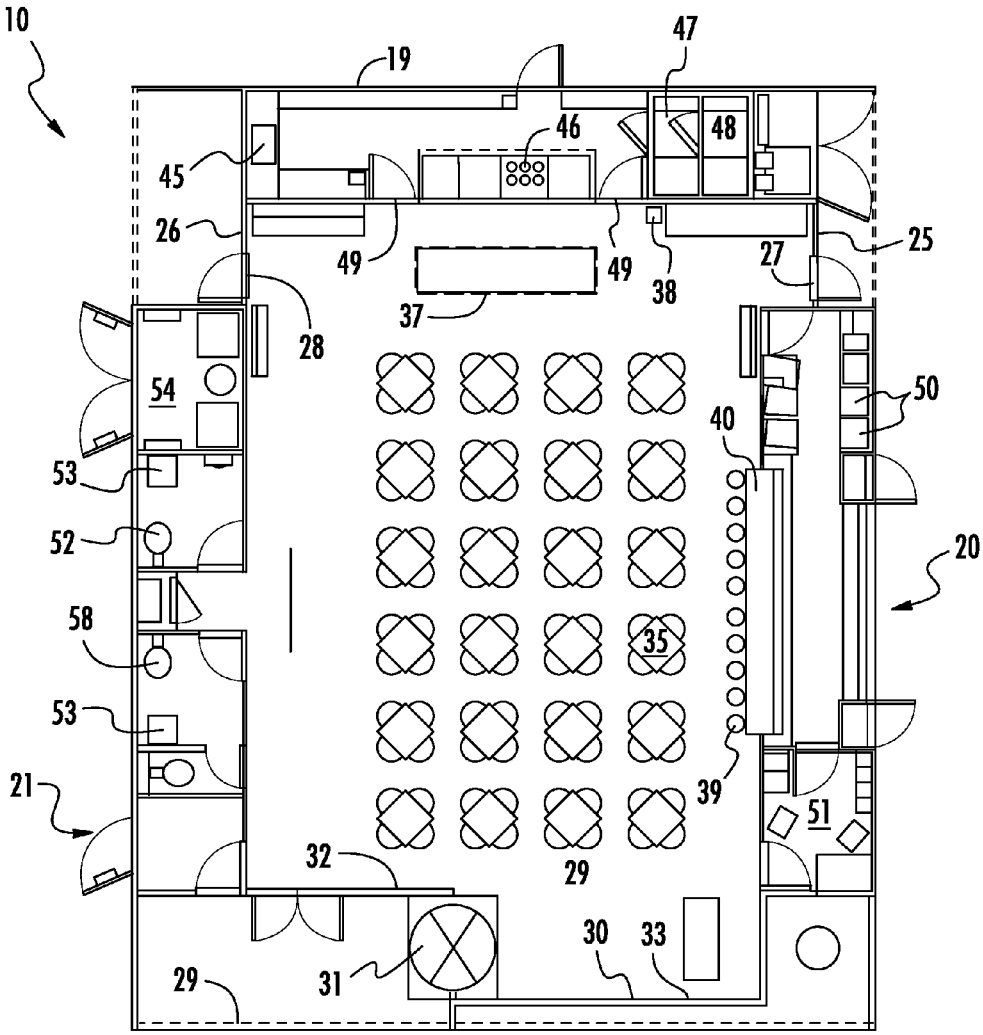
FIG. 6 is a top plan view of an exemplary embodiment of a relocatable restaurant fitted for use.
Figure 7:
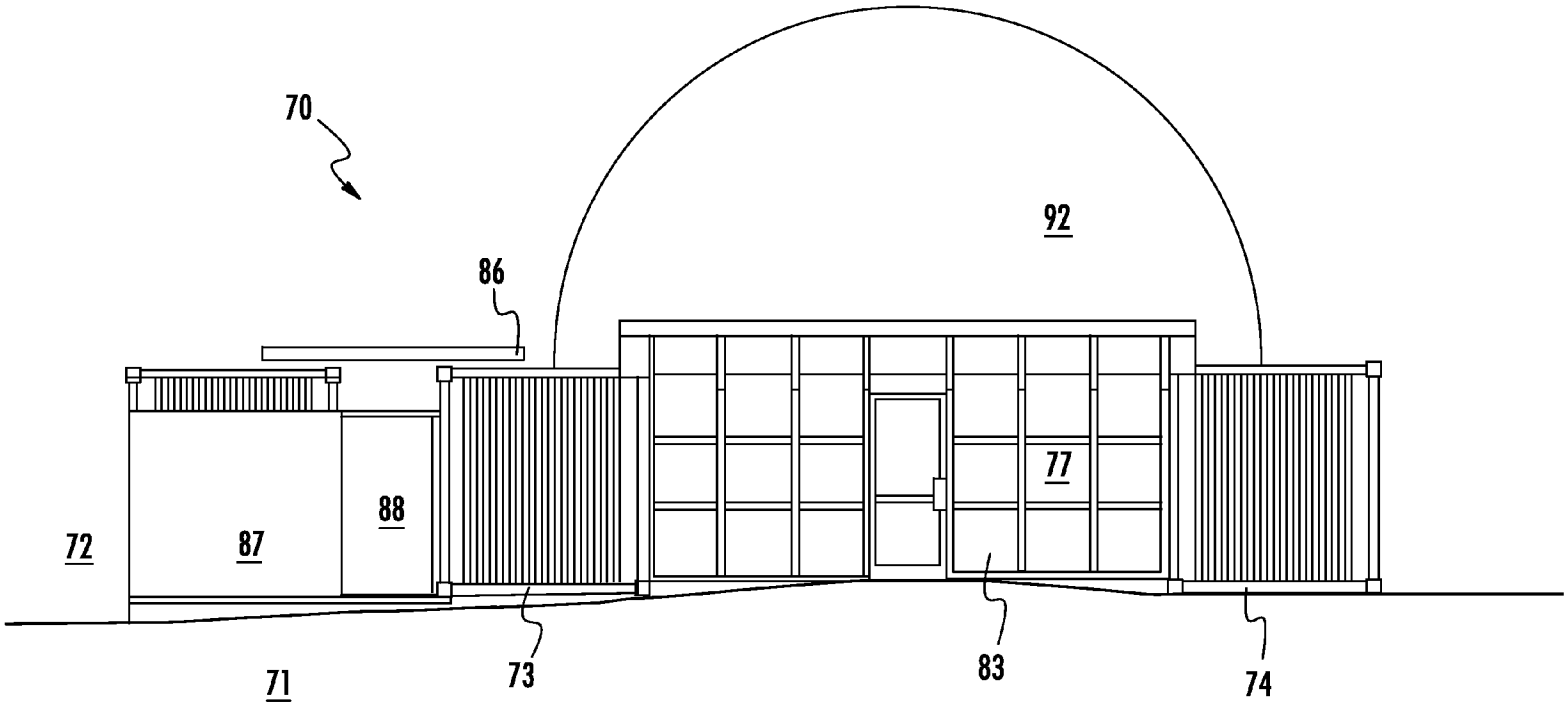
FIG. 7 is a front plan view of another embodiment of a relocatable restaurant.
Figure 8:
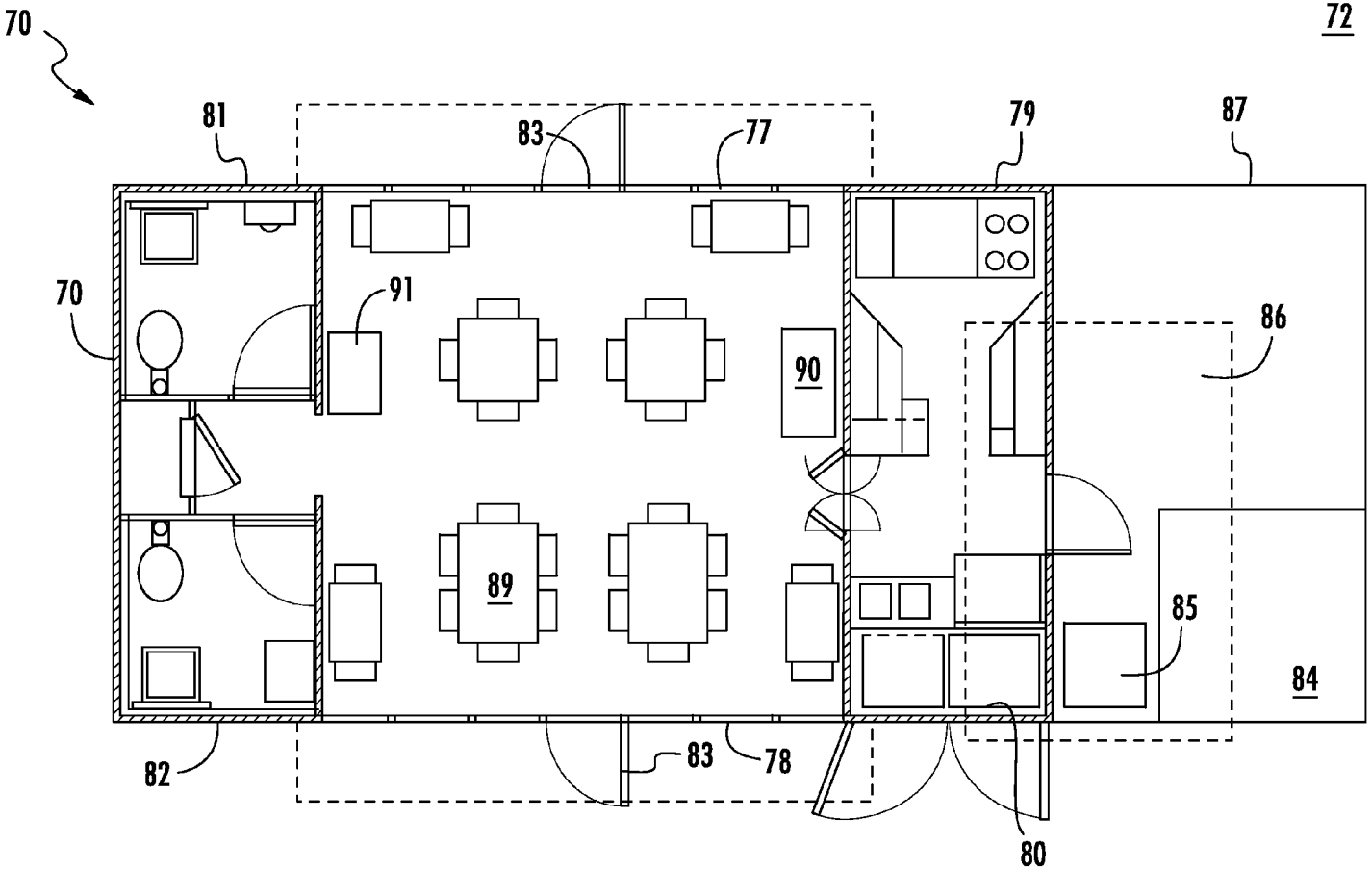
FIG. 8 is a top plan view of the interior of the embodiment of FIG. 7.

FIG. 6 illustrates an exemplary floor plan for the relocatable restaurant 10. The kitchen module 19 is shown as including sinks 45, stove and hood 46, refrigerator 47, freezer 48, and two interior doorways 49. The dishwashing and bar module 20 is shown as including at least one dishwasher 50 and an office area 51. The bathroom module 21 contains toilet facilities 52, sinks 53, and a mechanical area 54.

Another embodiment of a relocatable restaurant 70 (FIGS. 7 and 8) comprises a smaller construction, for serving, for example, 28 guests, although this is not intended as a limitation. In this embodiment 70, as for that 10 above, the relocatable restaurant 70 can be constructed by positioning or using an already-positioned slab 71 at a desired site 72. In a particular embodiment, the slab 71 is substantially rectangular and substantially planar, having two substantially rectangular recesses along two edges thereof, in similar fashion to the first embodiment 10. Preferably the slab 71 will have incorporated therein utility tie-ins. The recesses are dimensioned for positioning a plurality of modules, here, two containers 73,74, thereon.

Figure 11:
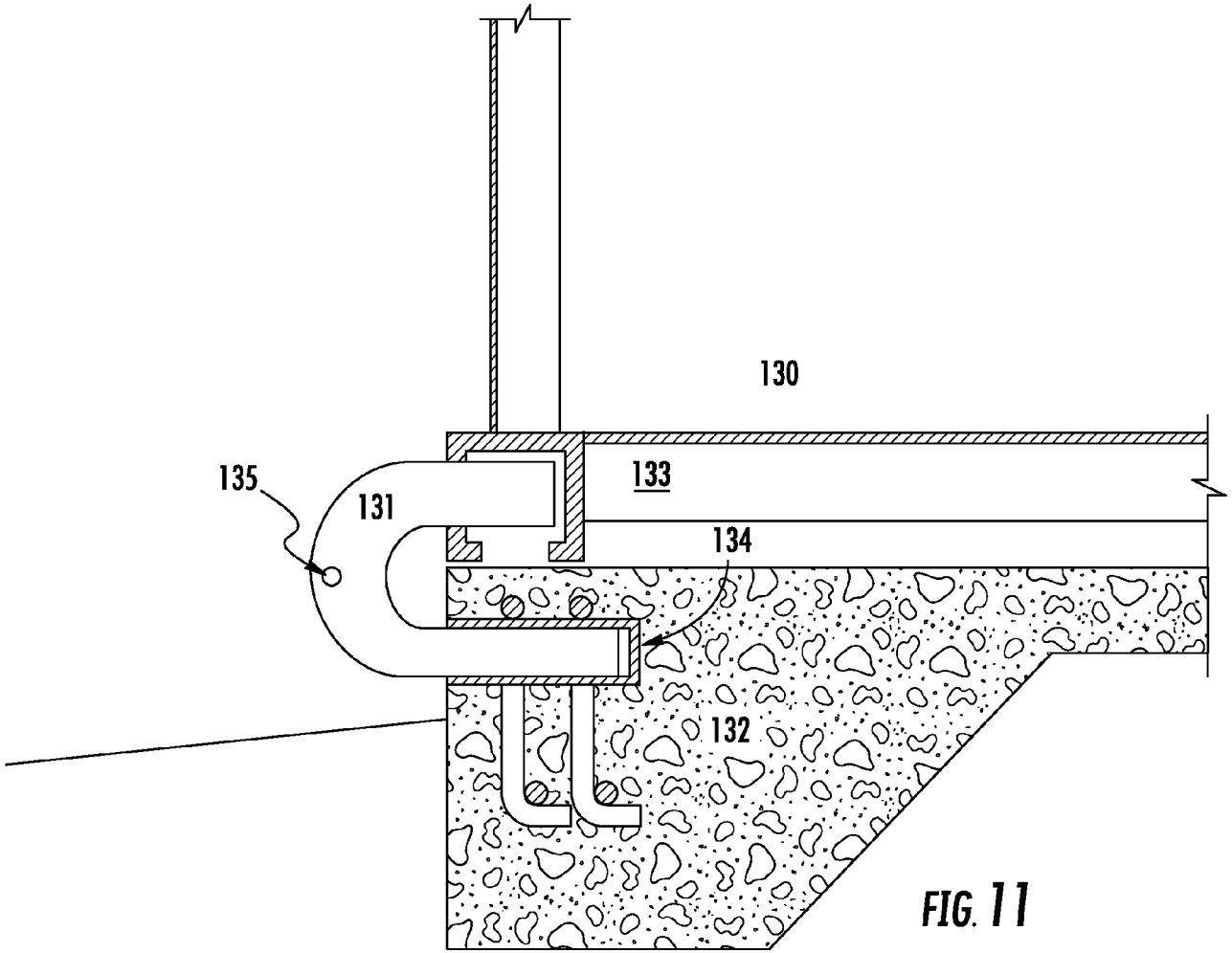
FIG. 11 is an edge section of a slab illustrating a pin anchoring mechanism.
Figure 14:
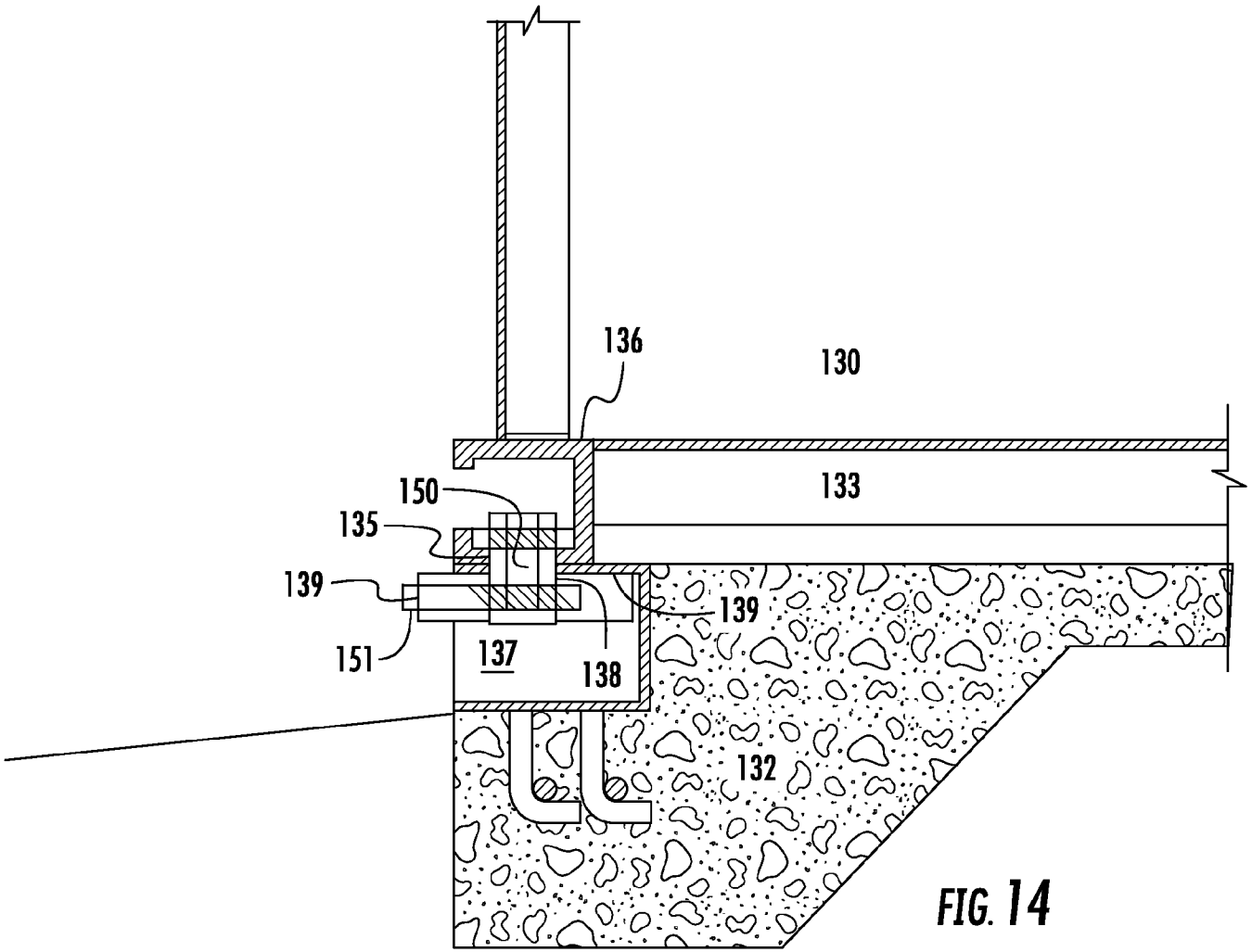
FIG. 14 is a cross-sectional view of a container anchoring structure.

FIG. 11 illustrates an exemplary container 130 being connected with a U-shaped pin 131 at a concrete slab 132. This container 130, if constructed similarly to a shipping container, has hard points at their corners 133, which permits the stacking of multiple containers during storage and transport. This corner construction permits the module to be held to the ground and resist uplift. Here the slab 132 has a precast hole and steel embedment 134 therein, and the pin 131 can be inserted into the hole 134 and the container corner 133. The pin 131 has a friction fit set with a sledgehammer, for example, and can be removed with a sliding hammer, by engaging an exposed hole 135 in the pin 131.

In another system for affixing the container 130 to the slab 132 (FIG. 14), the container 130 has a hole 135 through bottom, downwardly facing corners 136 thereof. The slab 132 has a substantially horizontal channel 137 therein, the steel embedment 137 having a hole 138 through a top surface 139 thereof. The slab embedment 137 and the container hole 135 are vertically alignable.

The relocatable restaurant structure further comprises a bolt 139 that is movable into the slab channel 137. The bolt 139 has a locking portion 150 that is distal of a proximal end 151 of the bolt 139. The locking portion 150 is elevatable to bridge the container hole 138 and the slab channel 137 for removably affixing the container 130 to the slab 132.

In an exemplary embodiment the containers 73,74 comprise a kitchen and dishwashing module 75, and a module 76 housing bathroom facilities. An exemplary construction and layout for the modules 75,76 will be discussed in the following.

The next step of erecting the relocatable restaurant 70 comprises positioning a plurality of partitions sufficient for bridging the modules 75,76 to create a substantially continuous exterior wall therearound. For example, two walls 77,78 can bridge respective ends 79,80;81,82 of the modules 75,76. At least one of the walls 77,78, and, here, both of the walls 77,78, can include an entry door 83. Windows can be provided as desired.

The relocatable restaurant 70 can also include one or more external constructions, such as a storage unit 84 and a trash unit 85, which are at least partially covered by a rain cover 86 and can be at least partially surrounded by a fence 87 with a gate 88 leading to the external constructions 84,85.

The relocatable restaurant 70 can be outfitted as above with furniture and other accoutrements (FIG. 8), such as indoor tables 89 and beverage and serving tables 90,91.

A roof 92 can again comprise a dome-like, upwardly extended flexible member, as described above for the first embodiment 10.

Figure 9:
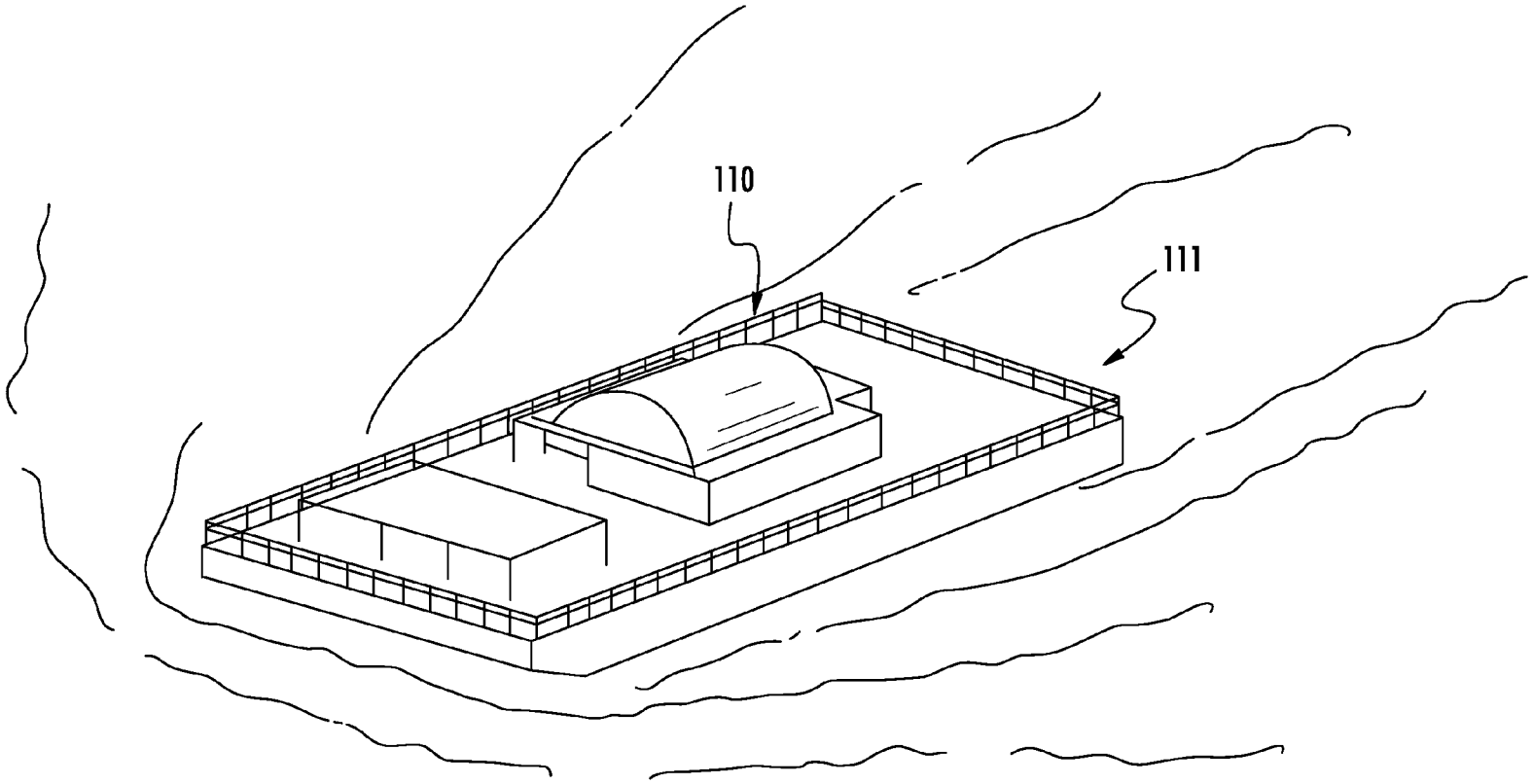
FIG. 9 is a top/side perspective view of a floating embodiment of a relocatable restaurant.
Figure 10:
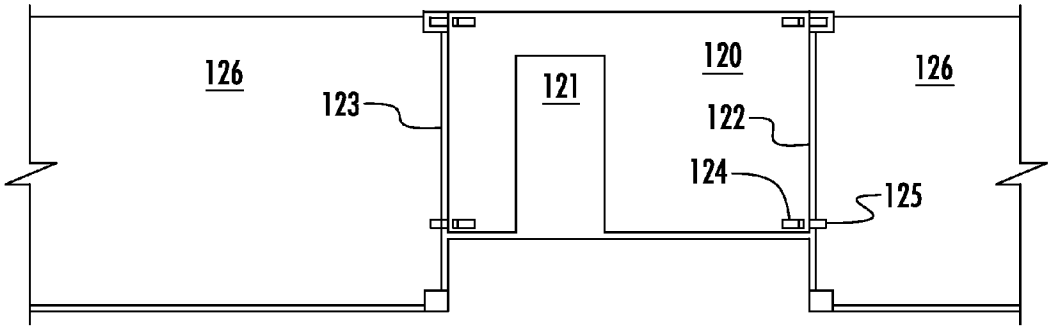
FIG. 10 is a front elevation view of a wall panel having a door incorporated therein.

In yet another embodiment, the relocatable restaurant 110 is positioned on a floatable platform such as, but not intended to be limited to, a barge 111 (FIG. 9).

Figure 16:
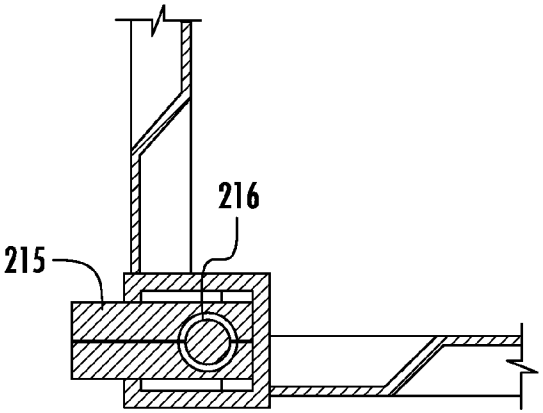
FIG. 16 is a horizontal cross-sectional view of the floor support mechanism of FIG. 15.
Figure 17:
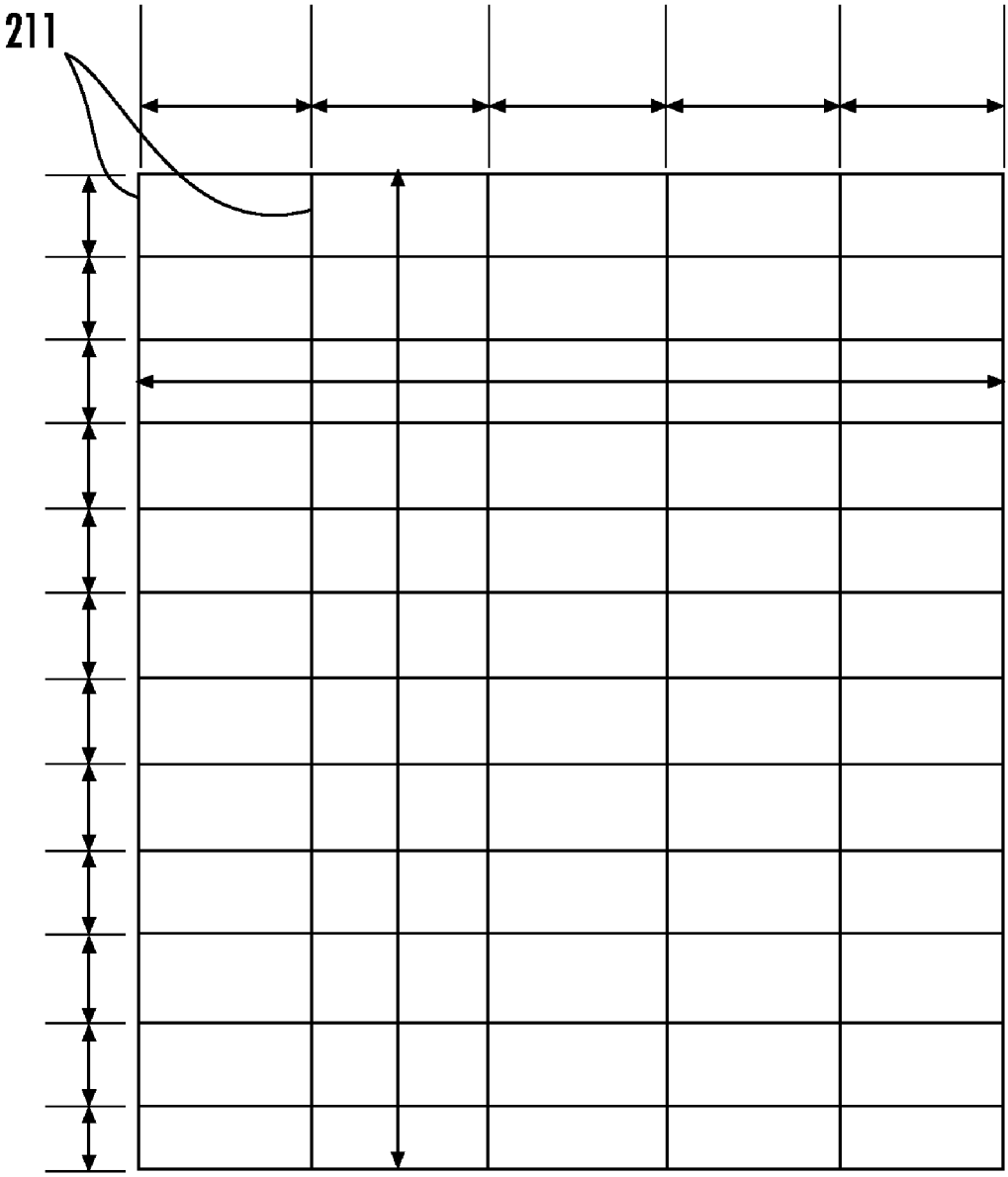
FIG. 17 is a top plan view of an exemplary beam pattern for supporting a raised floor system.
Figure 18:
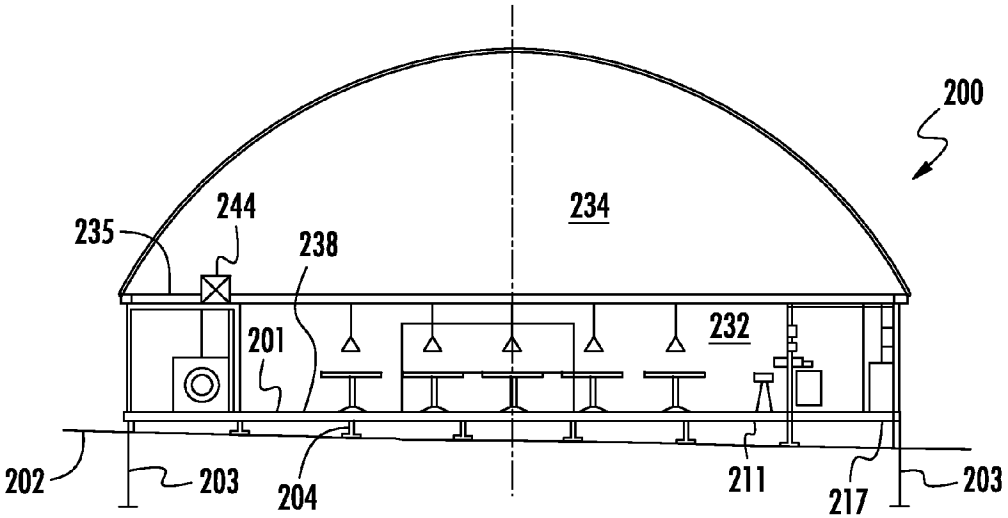
FIGS. 18 and 19 are cross-sectional views of an embodiment of a restaurant structure and raised floor with support system.
Figure 19:
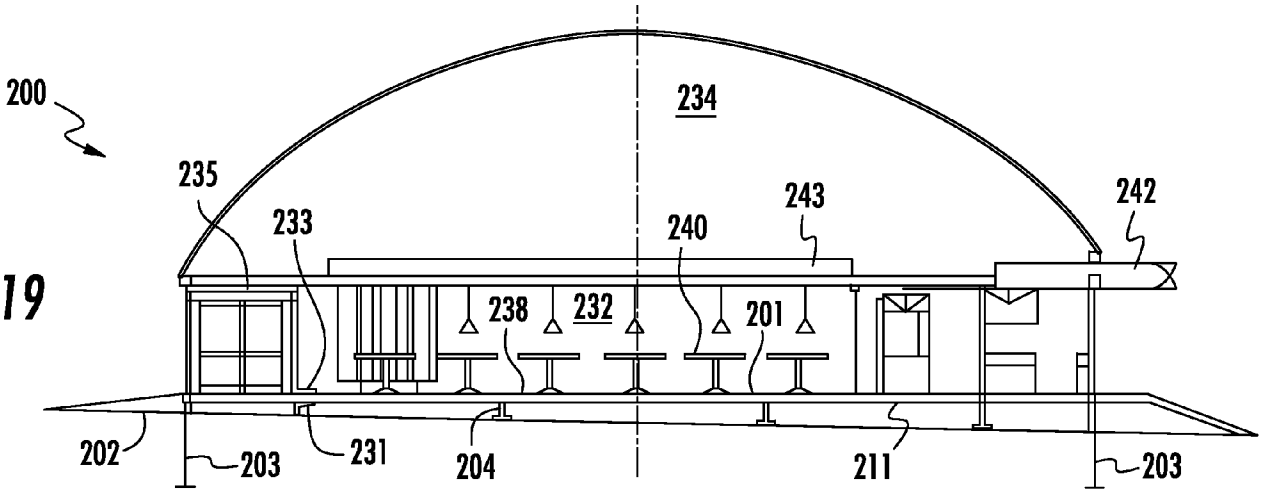
Figure 20:
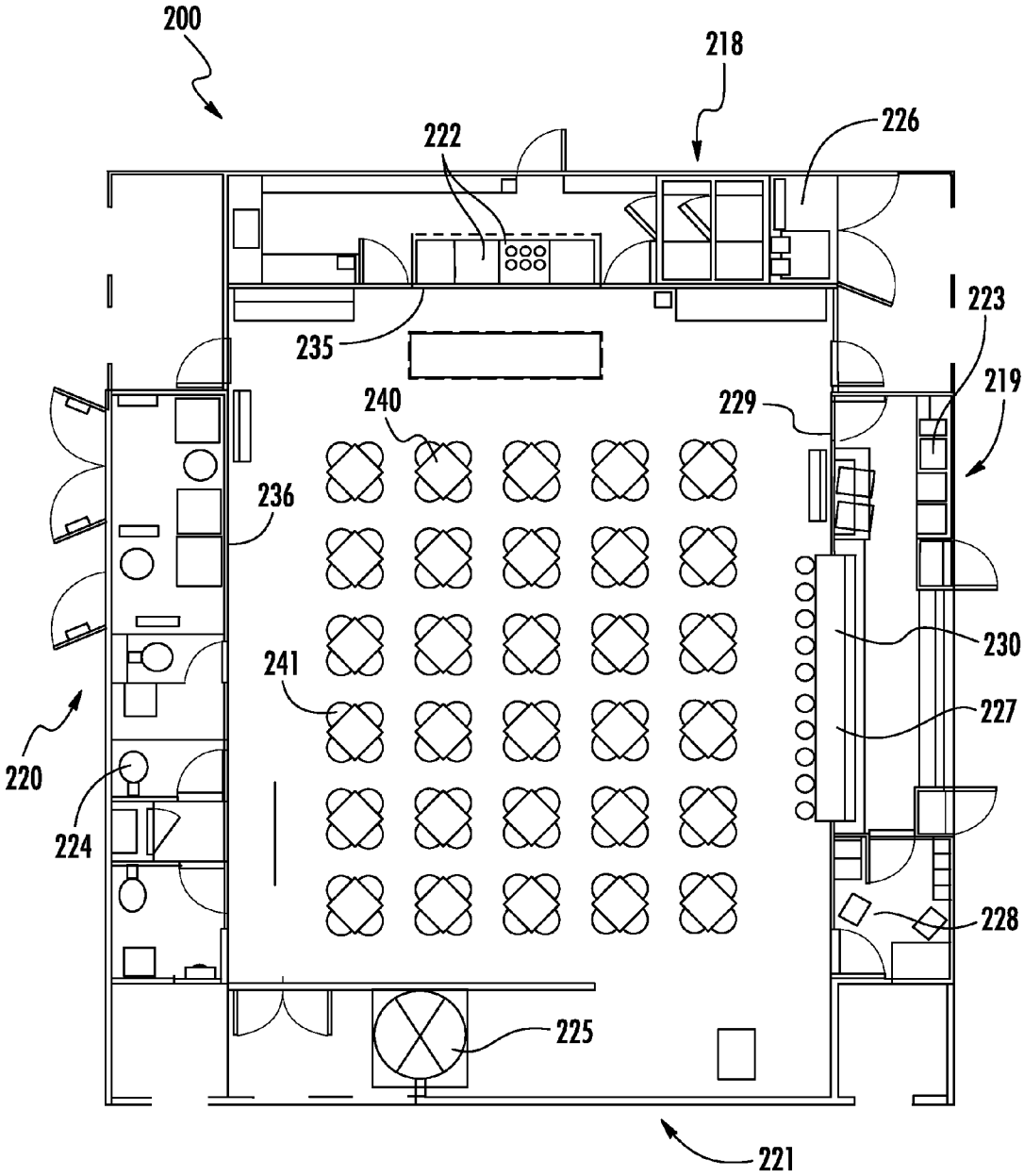
FIG. 20 is a top plan view of the structure of FIGS. 18 and 19.

A further embodiment of a relocatable restaurant 200 is illustrated in FIGS. 15-20. An exemplary arrangement of this relocatable restaurant structure 200 is illustrated in FIGS. 18-20, and comprises a raised floor 201 that is affixable atop a site surface 202. A plurality of anchors 203 are extendable beneath the site surface 202 for retaining the structure 200 in a desired position.

Figure 15:
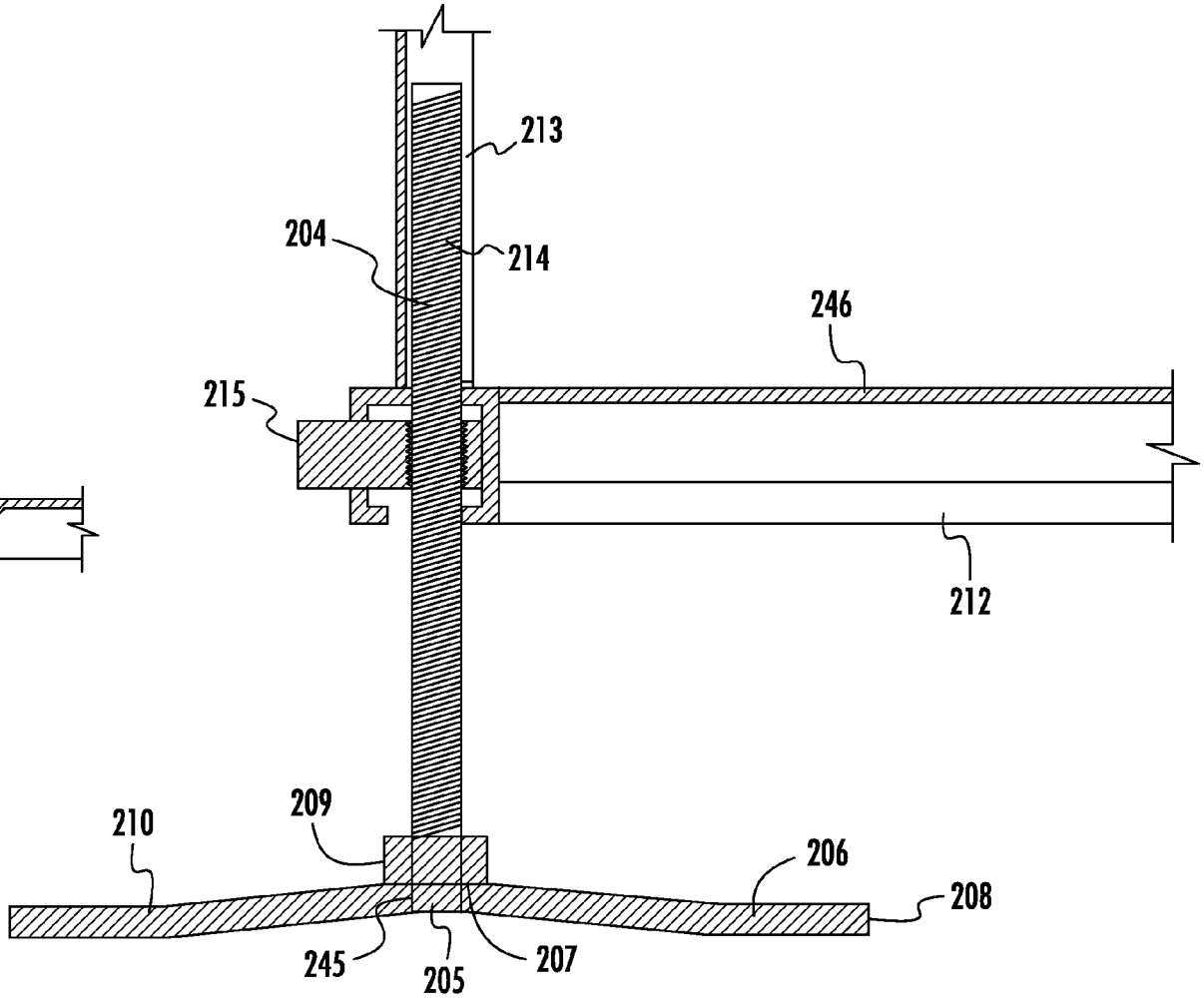
FIG. 15 is a side cross-sectional view of a floor support mechanism.

The floor 201 is supported and adjusted by a plurality of support elements positionable atop the site surface 202 and beneath the floor 201. In a particular embodiment, jack stands can be used to support the floor, and jack screws 204 are vertically adjustable for adjusting a height and a leveling of the floor 201 (FIGS. 15 and 16). Each jack screw 204 has a bottom end 205 that is rotatably affixable to a socket 245 in a base 206, such as a steel plate, that has an upward arch 207 in spaced relation from outer edges 208 thereof. A leveling nut 209 is positionable in surrounding relation to the jack screw 204 adjacent a top surface 210 of the support element base 206. The leveling nut 209 is rotatable for changing an elevation of the jack screw 204.

The relocatable restaurant structure 200 further comprises a plurality of spaced-apart, substantially parallel beams 211, which can be configured as illustrated in FIG. 17, although this arrangement is not intended as limiting. The jack screws 204 are positioned in supporting relation to the beams 211 (see, for example, FIGS. 18 and 19). A plurality of flooring panels 212 are positionable in abutting relation to each other atop the beams 211. The flooring panels 212 can comprise elements known in the art such as, but not intended to be limited to, honeycomb panels.

The container floors 246 can have a plurality of substantially vertical channels 213 therethrough that are dimensioned for admitting a top portion 214 of a jack screw 204 (FIGS. 15 and 16). A split nut 215 is insertable substantially horizontally into each floor channel 213. Each split nut 215 has an aperture 216 therethrough dimensioned for admitting the jack screw's top portion 214 and for securing the jack screw 204 relative to the floor channel 213. The ground anchors 203 are attached to the split nuts 215.

Positioned about the floor 201, generally adjacent outer edges 217 thereof, are four prefabricated containers 218-221. Although the contents of these containers 218-221 will be described herein, one of skill in the art will recognize that these arrangements are not intended to be limiting on the scope of the invention.

A first container 218 can have affixed therein kitchen equipment 222; a second container 219, dishwashing equipment 223, a third container 220, bathroom facilities 224; and a fourth container 221 having a door 225 therethrough. Further, the first container 218 can have affixed therein mechanical equipment 226. The second container 219 can further include bar 227 and office equipment 228. An inwardly facing wall 229 of the second container 227 can have a portion that is openable to form a bar surface 230.

In a particular embodiment, each of the containers 218-221 has a lip 231 extending into an interior space 232 adjacent a lower end 233 thereof. The lip 231 extends at least partially around a periphery of the interior space 232 and is positioned in supporting relation to the floor 201.

A flexible roof structure 234 is affixable adjacent top surfaces 235 of the containers 218-221. The roof structure 234 defines the interior space 232 along with inwardly facing walls 235,229,236,237 of the containers 218-221, respectively, and a top surface 238 of the floor 201. A blower is provided for retaining the roof structure 234 in a raised position.

The interior space 232 can be used to house, for example, a plurality of dining tables 240 that are removably affixable atop the floor 201, along with chairs 241. A detachable cooking hood 242 can be affixed to the first (kitchen) container 218. A cooking grease duct system can be fabricated into a unit and removed from the hood 242 and kitchen container 218 for cleaning and relocation. An electrical harness 243 can be provided to provide prewiring cabling. An air duct 244 can be positioned to vent the interior space 232.

The relocatable restaurant concept has a multiplicity of benefits. Virtually any menu can be supported with the facilities included therein. The relocatable restaurant 10,70,110,200 can be deployed stocked with food to desired locations, and can serve multiple high-volume locations on an event-driven schedule. The relocatable restaurant 10,70,110 is adaptable to any type of event and can be customized for any desired theme.

The relocatable restaurant 10,70,110,200 also has many economic benefits, as it is attractive to lenders as having a high asset recovery value, and to owners for its tax depreciation benefits (3 years as equipment versus 20 years as a fixed facility). The construction is "green," making it attractive to environmentally conscious owners and users.

The relocatable restaurant 10,70,110,200 is completely retrievable and relocatable, and meets all known permanent building codes and standards.

In an exemplary hybrid business method, the relocatable restaurant structure 10,70,110,200 can be used commercially, for example, military reserve personnel.

Reservists typically work in everyday jobs until they are called up in an emergency. The structure 10,70,110,200 could be used as a commercial structure during normal times. Then, in the case of a disaster, the structure 10,70,110,200 can be packed up and moved as needed.

Since the structure 10,70,110,200 could be used commercially and generate funds in its normal location as a restaurant, but could be seen as a national resource in the business community. When deployed, the restaurant's menu could be changed to fast meals and high throughput as needed.

The present structure 10,70,110,200 could be prepared to deploy with 24 hours' notice to a disaster location. Food could be pre-ordered food, and labor, such as for moving the structure 10,70,110,200, performed on a contract basis.

In another exemplary use of the relocatable restaurant structure 10,70,110,200, locations could be selected that have high populations that are short term (2 weeks to 3 months) and event based populations. This system provides the advantage of many locations operating at peak throughput, with only one structure. This structure 10,70,110,200 supplies a tool that is capable of delivering a fixed building experience to a much larger, targeted demographic at events with patrons of similar demographics, when said patrons are highly motivated by event jubilation and enjoyment so that they are more accepting by event association of new experiences and products offering them. The impression of surprise and amazement the structure casts the brand in a very positive and desirable light.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

What is claimed is:

1. A method for assembling a relocatable restaurant comprising: affixing a floor atop a site surface;

positioning each of four prefabricated containers adjacent an outer edge of the floor, a first container having affixed therein kitchen equipment, a second container having affixed therein dishwashing equipment, a third container having affixed therein bathroom facilities, and a fourth container having a door therethrough, each of the first, the second, the third, and the fourth container has a lip extending into the interior space adjacent a lower end thereof, extending at least partially around a periphery of the interior space, the lip in supporting relation to the floor;

affixing a flexible roof structure adjacent top surfaces of the containers, thereby defining an interior space along with inwardly facing walls of the first, the second, the third, and the fourth container, and a top surface of the floor;

extending a structural member about a periphery of the roof structure, for providing interconnection between and structural stability to the roof structure, wherein the structural member includes a plurality of soffit beams and wherein each soffit beam is formed by first and second beam sections longitudinally abutting each other at an intermediate portion thereof, wherein adjacent ends of each beam section includes a hole extending longitudinally therein, the soffit beam further comprising a sliding pin extending into the holes for connecting soffit beam section ends, the soffit beam further comprising a tab at opposing end portion thereof, wherein the tabs are dimensioned to be connected to hard corners of one container, and wherein a locking pin is connected between the beam section ends for thereby locking the soffit beam into the hard corners of the containers, and wherein the soffit beam sections are horizontally slidable into the container hard corners to thus have the plurality of soffit beams form a perimeter attachment for the roof structure so as to rigidly lock the structural member with the containers and roof structure; and maintaining above-atmospheric pressure within the interior space for retaining the roof structure in a raised position.

2. The method recited in claim 1, further comprising positioning a plurality of support elements atop the site surface in supporting relation to the floor, the support elements vertically adjustable for adjusting a height and a leveling of the floor.

3. The method recited in claim 2, wherein the support element positioning comprises:

inserting a top portion of each of a plurality of screws into a corresponding vertical channel in the floor;

inserting a split nut substantially horizontally into each floor channel;

admitting each screw top portion into an aperture of a corresponding split nut;

securing the screw through the split nut aperture and relative to the floor channel.

4. A method for providing temporary restaurant services at a site in a movable restaurant structure comprising:

transporting at least two prefabricated containers, a floor surface, bridging structures, and a roof structure to a desired site;

affixing a floor atop a surface of the site;

positioning each of the at least two prefabricated containers adjacent an outer edge of the floor, the containers having affixed therein restaurant equipment;

positioning a roof structure adjacent top surfaces of the containers;

extending a structural member about a periphery of the roof structure, for providing interconnection between and structural stability to the roof structure, wherein the structural member includes a plurality of soffit beams and wherein each soffit beam is formed by first and second beam sections longitudinally abutting each other at an intermediate portion thereof, wherein adjacent ends of each beam section includes a hole extending longitudinally therein, the soffit beam further comprising a sliding pin extending into the holes for connecting soffit beam section ends, the soffit beam further comprising a tab at opposing end portion thereof, wherein the tabs are dimensioned to be connected to hard corners of one container, and wherein a locking pin is connected between the beam section ends for thereby locking the soffit beam into the hard corners of the containers, and wherein the soffit beam sections are horizontally slidable into the container hard corners to thus have the plurality of soffit beams form a perimeter attachment for the roof structure so as to rigidly lock the structural member with the containers and roof structure;

affixing the bridging structures between the containers the bridging structures defining an interior space along with inwardly facing walls of the at least two containers, a top surface of the floor, and a bottom surface of the rood structure;

anchoring the at least two containers and the floor to the site surface;

positioning serving equipment within the interior space, including tables and chairs;

preparing and serving food within the interior space;

disassembling the restaurant structure; and transporting the at least two prefabricated containers, the floor surface, the bridging structures, and the roof structure to a second desired site.

5. A relocatable restaurant structure comprising:

a dining area floor affixable to a base positioned adjacent a site surface;

at least two prefabricated containers having a container floor, each positioned adjacent an outer edge of the dining area floor, each container having affixed therein restaurant equipment, wherein each container includes a plurality of hard corners providing structural support thereto;

a roof structure affixable adjacent top surfaces of the containers, the roof structure defining an interior space along with inwardly facing walls of the at least two containers, a top surface of the floors, and inwardly facing walls of the bridging means;

a structural member extending about a periphery of the roof structure, the structural member providing interconnection between and structural stability to the roof structure, wherein the structural member includes a plurality of soffit beams and wherein each soffit beam is formed by first and second beam sections longitudinally abutting each other at an intermediate portion thereof, wherein adjacent ends of each beam section includes a hole extending longitudinally therein, the soffit beam further comprising a sliding pin extending into the holes for connecting soffit beam section ends, the soffit beam further comprising a tab at opposing end portion thereof, wherein the tabs are dimensioned to be connected to hard corners of one container, and wherein a locking pin is connected between the beam section ends for thereby locking the soffit beam into the hard corners of the containers, and wherein the soffit beam sections is are horizontally slidable into the container hard corners to thus have the plurality of soffit beams form a perimeter attachment for the roof structure so as to rigidly lock the structural member with the containers and roof structure; and an anchor affixable at a top end to each container and a bottom end to the site surface.

6. The relocatable restaurant structure recited in claim 5, wherein the roof structure comprises a flexible roof structure and further comprising a blower for retaining the roof structure in a raised position.

7. The relocatable restaurant structure recited in claim 5, wherein the at least two containers comprise at least one of a first container having mechanical equipment affixed therein; a second container having affixed therein bar and office equipment, an inwardly facing wall thereof openable to form a bar surface; a third container having affixed therein kitchen equipment; a fourth container having affixed therein dishwashing equipment; and a fifth container having affixed therein bathroom facilities.

8. The relocatable restaurant structure recited in claim 5, further comprising a plurality of dining tables removably affixable atop the floor within the interior space.

9. The relocatable restaurant structure recited in claim 5, wherein the base comprises a floatable structure, for relocating the structure via water.

10. The relocatable restaurant structure recited in claim 5, wherein the base comprises a plurality of support elements positionable atop the base and in supporting relation to the dining floor, the support elements vertically adjustable for adjusting a height and a leveling of the dining floor.

11. The relocatable restaurant structure recited in claim 10, wherein the support elements comprise vertical screws, and wherein the at least two containers comprise:

a plurality of substantially vertical channels therethrough dimensioned for admitting a top portion of one vertical screw;

a split nut insertable substantially horizontally into each corner of each of the at least two containers, each split nut having an aperture therethrough dimensioned for admitting the vertical screw top portion and for securing the vertical screw relative to the at least two containers.

12. The relocatable restaurant structure recited in claim 10, wherein the support elements each comprise:

a support element base having an upward arch in spaced relation from outer edges thereof;

a jack screw having a bottom end rotatably affixable to the support element base;

a leveling nut positionable in surrounding relation to the jack screw adjacent a top surface of the support element base, the leveling nut rotatable for changing an elevation of the jack screw.

13. The relocatable restaurant structure recited in claim 10, wherein the dining floor comprises:

a plurality of spaced-apart, substantially parallel beams extending between two of the at least two containers, the two containers opposed from each other, the vertical screws positioned in supporting relation to the beams; and a plurality of flooring panels positionable in abutting relation to each other atop the beams.

14. A relocatable restaurant structure comprising:

a floor affixable atop a site surface;

four prefabricated containers, each positioned adjacent an outer edge of the floor, a first container having affixed therein kitchen equipment, a second container having affixed therein dishwashing equipment, a third container having affixed therein bathroom facilities, and a fourth container having a door therethrough;

a flexible roof structure affixable adjacent top surfaces of the containers, the roof structure defining an interior space along with inwardly facing walls of the first, the second, the third, and the fourth container, and a top surface of the floor;

a structural member extending about a periphery of the flexible roof structure, for providing interconnection between and structural stability to the flexible roof structure, wherein the structural member includes a plurality of soffit beams and wherein each soffit beam is formed by first and second beam sections longitudinally abutting each other at an intermediate portion thereof, wherein adjacent ends of each beam section includes a hole extending longitudinally therein, the soffit beam further comprising a sliding pin extending into the holes for connecting soffit beam section ends, the soffit beam further comprising a tab at opposing end portion thereof, wherein the tabs are dimensioned to be connected to hard corners of one container, and wherein a locking pin is connected between the beam section ends for thereby locking the soffit beam into the hard corners of the containers, and wherein the soffit beam sections is are horizontally slidable into the container hard corners to thus have the plurality of soffit beams form a perimeter attachment for the roof structure so as to rigidly lock the structural member with the containers and roof structure; and a blower for retaining the roof structure in a raised position; wherein:

each of the first, the second, the third, and the fourth container has a lip extending into the interior space adjacent a lower end thereof, extending at least partially around a periphery of the interior space, the lip in supporting relation to the floor.

15. The relocatable restaurant structure recited in claim 14, wherein the first container further has affixed therein mechanical equipment; and the second container further has affixed therein bar and office equipment, an inwardly facing wall thereof openable to form a bar surface.

16. The relocatable restaurant structure recited in claim 14, further comprising a plurality of dining tables removably affixable atop the floor within the interior space.

17. The relocatable restaurant structure recited in claim 14, further comprising a plurality of support elements positionable atop the site surface and in supporting relation to the floor, the support elements vertically adjustable for adjusting a height and a leveling of the floor.

18. The relocatable restaurant structure recited in claim 17, wherein the support elements comprise jack screws, and wherein each container comprises:

a plurality of substantially vertical channels therethrough dimensioned for admitting a top portion of a vertical screw; and a split nut insertable substantially horizontally into each floor channel, each split nut having an aperture therethrough dimensioned for admitting one screw top portion and for securing the screw relative to the container.

19. The relocatable restaurant structure recited in claim 17, wherein the support elements each comprise:

a support element base having an upward arch in spaced relation from outer edges thereof;

a vertical screw having a bottom end rotatable affixable to the support element base; and a leveling nut positionable in surrounding relation to the screw adjacent a top surface of the support element base, the leveling nut rotatable for changing an elevation of the screw.

* * * * *